US006617793B2

(12) United States Patent
Choi et al.

(10) Patent No.: US 6,617,793 B2
(45) Date of Patent: Sep. 9, 2003

(54) RESONATOR FOR MICROWAVE LIGHTING APPARATUS AND MANUFACTURING METHOD THEREOF

(75) Inventors: Joon Sik Choi, Seoul (KR); Yong Seog Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/987,126

(22) Filed: Nov. 13, 2001

(65) Prior Publication Data

US 2002/0074917 A1 Jun. 20, 2002

(30) Foreign Application Priority Data

Dec. 18, 2000 (KR) ..... 2000-77769

(51) Int. Cl.[7] ..... H01J 65/04

(52) U.S. Cl. ..... 315/39; 315/39.77; 315/248; 333/227

(58) Field of Search ..... 315/39, 39.51, 315/39.53, 39.77, 248, 267, 344; 372/92; 333/227, 230

(56) References Cited

U.S. PATENT DOCUMENTS 4,673,846 A * 6/1987 Yoshizawa et al. ..... 315/248
5,905,342 A * 5/1999 Mimasu et al. ..... 315/39
5,998,934 A * 12/1999 Mimasu et al. ..... 315/118

* cited by examiner

*Primary Examiner*—Don Wong
*Assistant Examiner*—Thuy Vinh Tran
(74) *Attorney, Agent, or Firm*—Birch, Stewart, Kolasch & Birch, LLP

(57) ABSTRACT

A resonator for use in microwave lighting apparatus includes a mesh portion formed in a cylindrical shape with one side opened, at least one portion of which prevents microwave transmitted through a waveguide from leaking and light radiated from a light bulb is transmitted outwardly, the mesh portion being formed integral without a joint. Since the portion of the mesh structure is integrally formed as one body without a joint rather than being welded to be coupled, the microwave is prevented from leaking. In addition, since the holes of the mesh portion are uniformly formed without any clogged portion, the light transmittance area is enlarged, improving the light efficiency of the lighting apparatus.

17 Claims, 8 Drawing Sheets

RESONATOR FOR MICROWAVE LIGHTING APPARATUS AND MANUFACTURING METHOD THEREOF

BACKGROUND OF THE INVENTION

1. Field of the Invention

The present invention relates to a lighting apparatus using microwave, and more particularly, to a resonator of a microwave lighting apparatus having a mesh structure which is capable of preventing microwave transmitted through a waveguide from leaking and transmitting light radiated from a light bulb outwardly, and its manufacturing method.

2. Description of the Background Art

A microwave lighting apparatus is an instrument to apply microwave to an electrodeless light bulb to obtain a visible ray or ultraviolet rays therefrom. The a lamp adopting microwave lighting apparatus has a long lifespan and an excellent illumination effect compared to the general electric lamp or a fluorescent lamp.

FIG. 1 is a vertical-sectional view of a general microwave lighting apparatus.

As shown in FIG. 1, the microwave lighting apparatus includes a magnetron 5 for generating microwave, a waveguide 3 for transmitting the microwave from the magnetron 1, a light bulb 5 for generating light as a substance encapsulated in the light bulb is turned to plasma by the microwave energy transmitted thorugh the waveguide 3, and a resonator 20 for covering the front side of the waveguide 3 and the light bulb 5 to prevent microwave from leaking and transmitting light radiated from the light bulb 5.

With this fundamental structure, the microwave lighting apparatus further includes a high voltage generator 7 for boosting a common AC power to a high pressure and providing it to the magnetron 1, a cooling unit 9 for cooling the magnetron 1 and the high voltage generator 7, a reflection mirror 11 for collectively reflecting the light generated from the light bulb 5 forwardly, a light bulb motor 13 and a motor shaft 15 for rotating the light bulb 5, and cooling the heat while discharging the light, and a controller (not shown) for controlling varous factors including the high voltage generator 7 and the cooling unit 9.

In the microwave lighting apparatus, when the controller inputs a drive signal to the high voltage generator 7, the high voltage generator 7 boosts a received AC power and provides the boosted high pressure to the magnetron 1.

The magnetron 1 generates microwave having a very high frequency as being oscillated by the high pressure supplied from the high voltage generator 7, and thusly generated microwave is radiated into the resonator 20 through the waveguide 3 to discharge the substance encapsulated in the light bulb 5 and generate light having an inherent discharging spectrum.

In this manner, the light generated from the light bulb 5 is reflected to the front side through the mirror 12 and the reflection mirror 11 and lights a place of its insulation site.

FIG. 2 is a perspective view of the resonator used for the microwave lighting apparatus in accordance with a conventional art, and FIGS. 3A and 3B are a detailed view of the portion 'A' of FIG. 2 and sectional view taken along line B—B of FIG. 2, respectively.

With reference to FIG. 1, the resonator 20 has a metal mesh form and is assembled at the side of exit 3*a* of the waveguide 3, so that it impounds microwave transmitted through the waveguide 3 and transforms the microwave energy to light within the light bulb 5, and at the same time, prevents the microwave from leaking and transmits the light generated from the light bulb 5 outwardly.

With reference to FIGS. 2 and 3, the resonator 20 includes, besides a portion of the opened portion 20*a,* a cylindrical unit 21 on which a plurality of holes 20*b* are formed by an etching process and a lid unit 25 formed convex and connected to the front portion of the cylindrical unit 21, having a plurality of holes 20*b*.

The cylindrical unit 21 includes a mesh portion 22 for preventing microwave from leaking and transmitting light, and a fixed portion 23 fixed at the outlet portion of the waveguide 3. The fixed portion 23 is not subjected to the etching process. The fixed portion 23 included a plurality of slit portions 23*a,* so as is to be extended and easily assembled when it is installed at the waveguide 3.

FIG. 4 is a flow chart of a process of manufacturing the resonator in accordance with the conventional art.

The process for manufacturing the resonator will now be explained with reference to FIGS. 2 and 4.

First, in order to fabricate the cylindrical unit 21, a metal thin film of a predetermined thickness made of a stainless steel or phosphor bronze is cut in a rectangular shape, and the remaining portion except the fixed portion 23 is etched to form holes 20*b* to form a mesh portion 22.

The holes 20*b* formed by etching the metal thin film has such a size as to prevent leakage of microwave and a maximum aperture efficiency so that the light radiated from the light bulb 5 of FIG. 1 can be emitted outwardly at the maximum.

Next, the mesh thin film is bent to a cylindrical shape and the both end portions are put into contact and welded. At this time, the both end portions are put into contact and directly welded, or as shown in FIG. 3A, a reinforcing member 24 is applied on the portion where the both end portions 21*a* and 21*b* are put into contact and welded to fabricate the cylindrical unit 21.

At this time, it is to be cautioned that the both end portions 21*a* and 21*b* of the mesh thin film shouldn't be welded as being folded. The reason for this is that, if a step is formed at the welded portion, when the resonator 20 is assembled to the waveguide 3, a gap occurs between the resonator 20 and the waveguide 3, through which microwave may be leaked.

In order to fabricate the lid unit 25, a metal thin film with a predetermined thickness made of stainless steel or phosphor bronze is cut in a circle form and etched to form the holes 20*b* to form the mesh structure like the cylindrical unit 21.

Thereafter, a lid unit 25 is fabricated with its circumferential marginal portion bent so as to couple the mesh thin film to the cylindrical unit 21.

Next, the cylindrical unit 21 and the lid unit 25 are coupled and the coupled portion is welded to fabricate the resonator 20, and then silver or platinum or a platinum family is plated on the surface of the resonator 20 to heighten the reflectivity of light and reduce an electric resistance of the surface, thereby completing the resonator 20.

However, the conventional resonator has the following problems.

That is, for example, first, since the rectangular thin film and the circular thin film are etched to form the holes 20*b* and welded, the fabrication process of the resonator 20 is complicated.

Secondly, if the welded portion is detached due to intense heat generated in the process that the microwave energy is switched to the light energy, the microwave may leaked outwardly.

Thirdly, when the resonator is fabricated by using the welding method, even though the welded portion is not detached, it may be oxidized to be detached due to the intense heat generated from the light bulb 5 of the resonator 20, a long-time reliability is not guaranteed.

Fourthly, in the case that the cylindrical unit 21 of the resonator 20 is formed, since the holes 20*b* are not formed at the welded portion and the welded portion by coupling the cylindrical unit 21 and the lid unit 25 as shown in FIG. 3B, the light radiated from the light bulb 5 is not transmitted therethrough, causing a problem that the aperture efficiency of the whole resonator 20 is degraded and the light efficiency of the lighting apparatus is accordingly degraded.

SUMMARY OF THE INVENTION

Therefore, an object of the present invention is to provide a resonator of a microwave lighting apparatus that is capable of preventing microwave from leaking, heightening the whole aperture efficiency and improving a light efficiency by integrally forming a portion with a mesh structure without a joint by not welding it.

Another object of the present invention is to provide a method for manufacturing a resonator of a microwave lighting apparatus that is capable of facilitating manufacturing of a resonator and manufacturing a resonator in various forms as necessary by integrally manufacturing the resonator without a joint by using an electro-forming method.

To achieve these and other advantages and in accordance with the purpose of the present invention, as embodied and broadly described herein, there is provided a resonator using microwave lighting apparatus including a mesh portion formed in a cylindrical shape with one side opened, at least one portion of which prevents microwave transmitted through a waveguide from leaking and light radiated from a light bulb is transmitted outwardly, the mesh portion being formed integral without a joint.

To achieve the above objects, there is also provided a resonator of a microwave lighting apparatus including an opening portion formed connected to a waveguide at one side of a cylindrical portion and a clogged front portion at the opposite side of the opening portion, a mesh portion is formed at the cylindrical portion and the front portion and connected through a fixing unit, each mesh portion is integrally formed without a joint.

To achieve the above objects, there is also provided a method for manufacturing a resonator of a microwave lighting apparatus including the steps of: forming a cylindrical resonator with one side opened and the other side clogged by using an electro-forming method to have a mesh structure without a joint; and heat-treating the resonator to reinforce its strength.

To achieve the above objects, there is also provided a method for manufacturing a resonator of a microwave lighting apparatus including the steps of: forming a cylindrical body with both sides opened by using an electro-forming method to have a mesh structure without a joint, separately fabricating a front portion in a mesh structure, attaching it to one side of the cylindrical body to form a resonator; and heat-treating the resonator to reinforce its strength.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
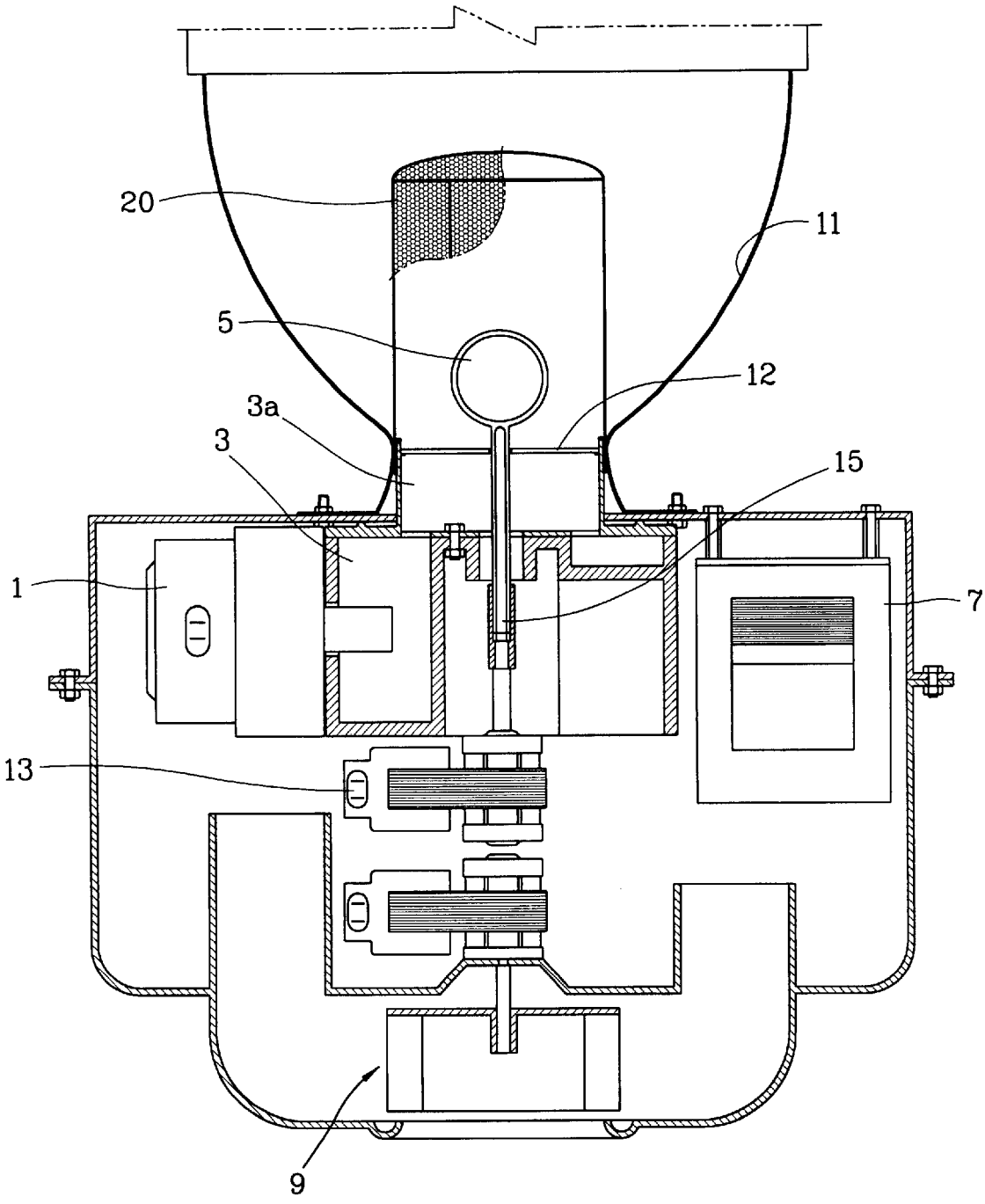
FIG. 1 BACKGROUND ART
FIG. 1 is a vertical-sectional view of a general microwave lighting apparatus.
Figure 2:
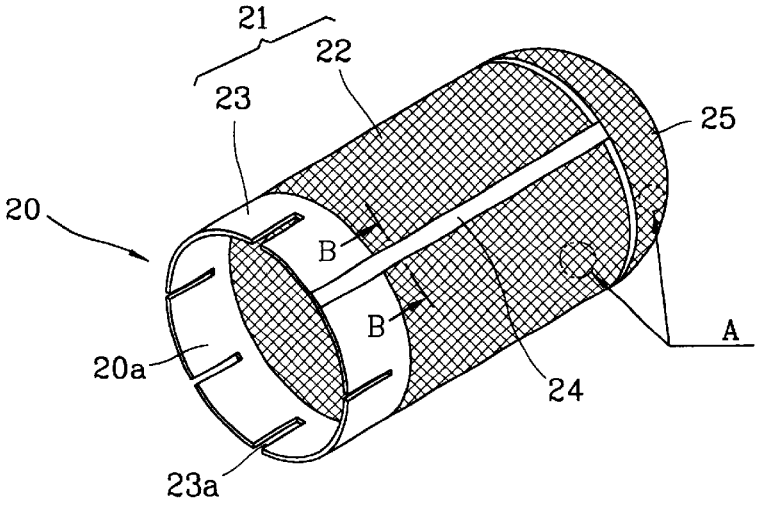
FIG. 2 BACKGROUND ART
FIG. 2 is a perspective view of a resonator in accordance with a conventional art.
Figure 3A:
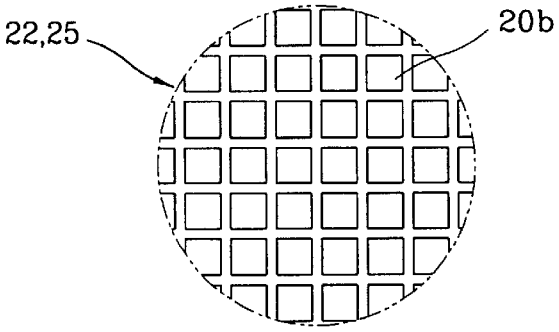
FIG. 3A BACKGROUND ART
FIG. 3A is an enlarged view of a portion 'A' of FIG. 2 in accordance with the conventional art.
Figure 3B:
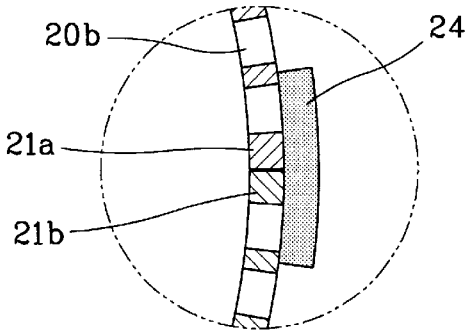
FIG. 3B BACKGROUND ART
FIG. 3B is a sectional view taking along line B—B of FIG. 2 in accordance with the conventional art.
Figure 4:
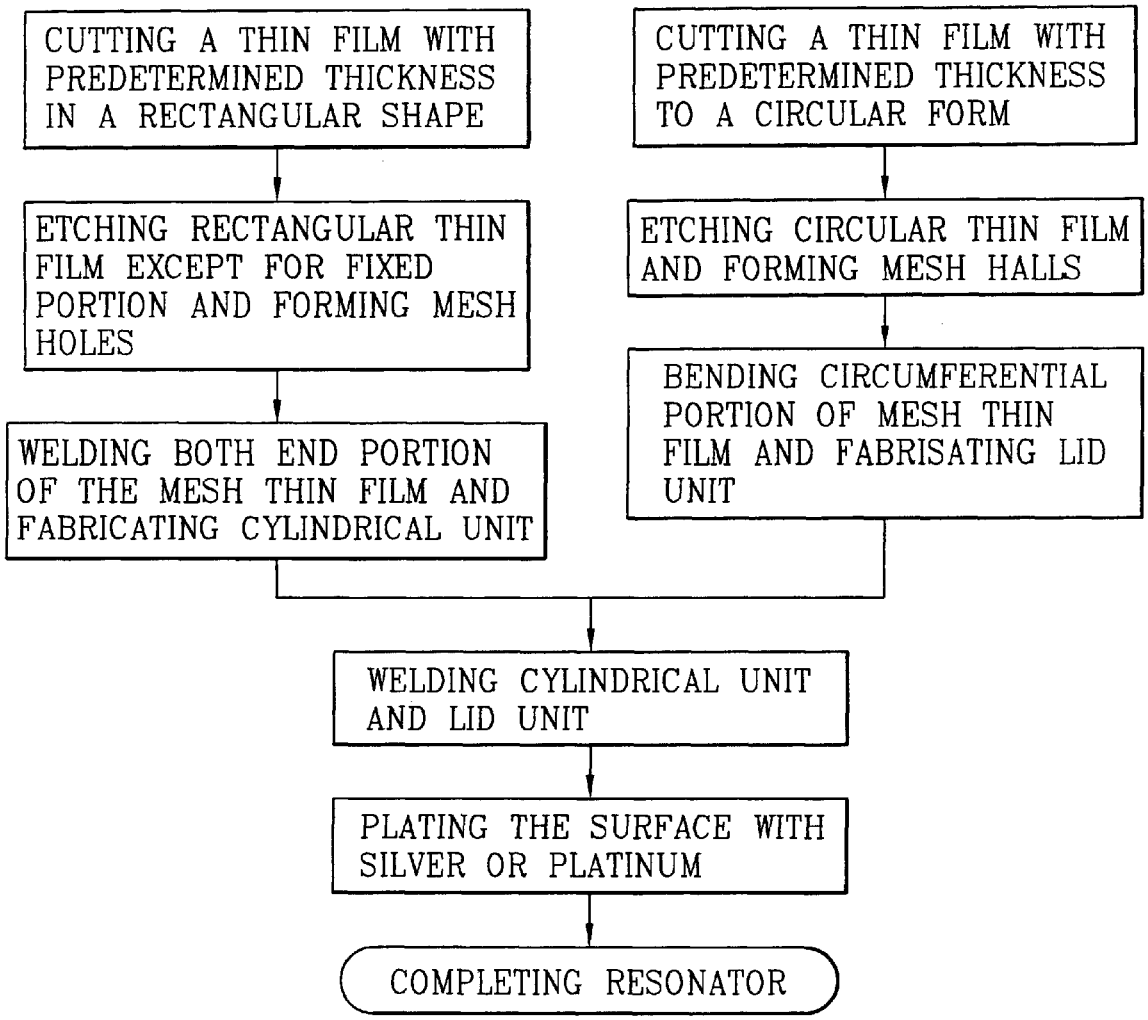
FIG. 4 BACKGROUND ART
FIG. 4 is a flow chart of a method for fabricating a resonator in accordance with the conventional art.
Figure 5:
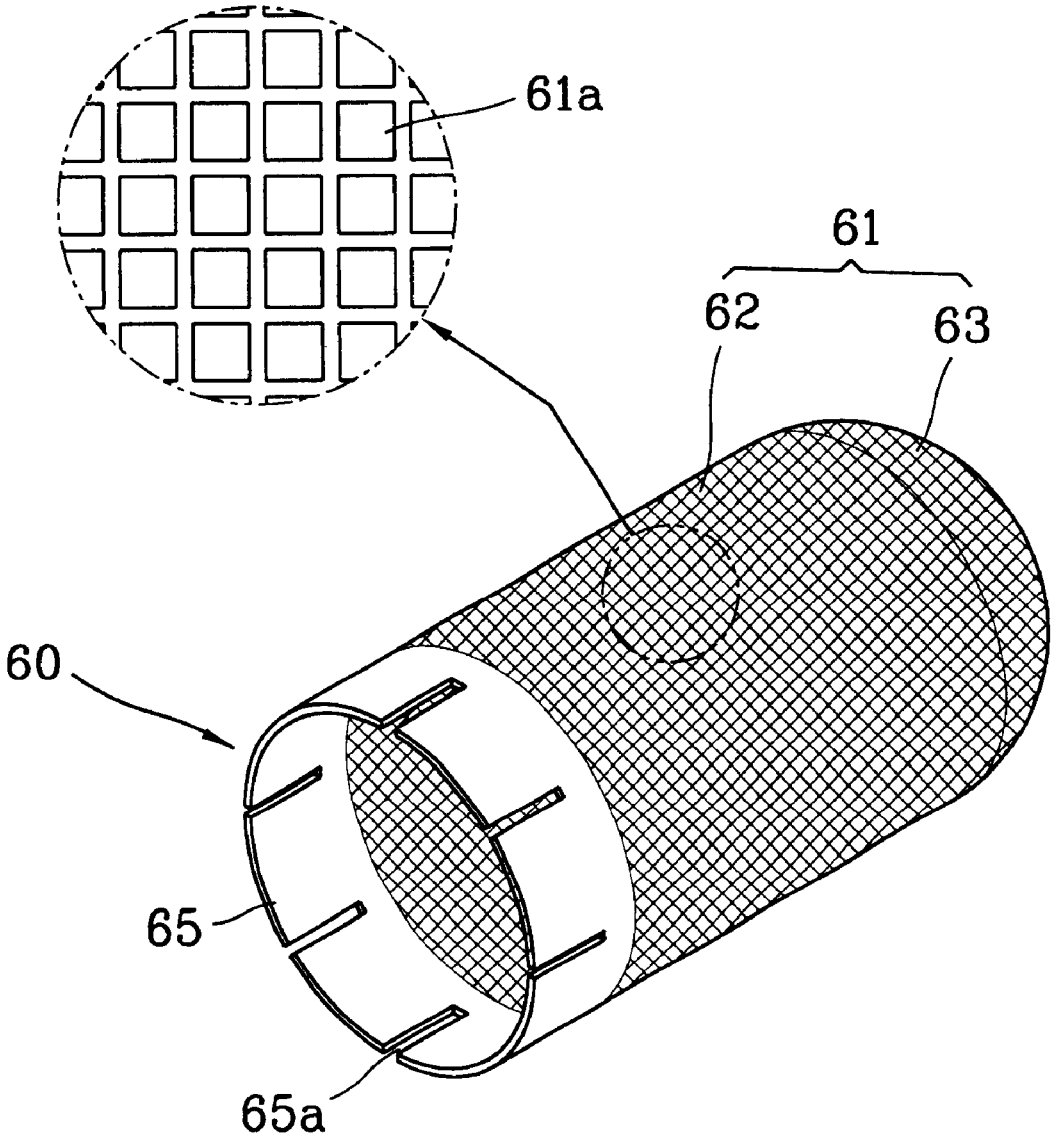
FIG. 5 is a perspective view of a resonator in accordance with a first embodiment of the present invention.
Figure 6:
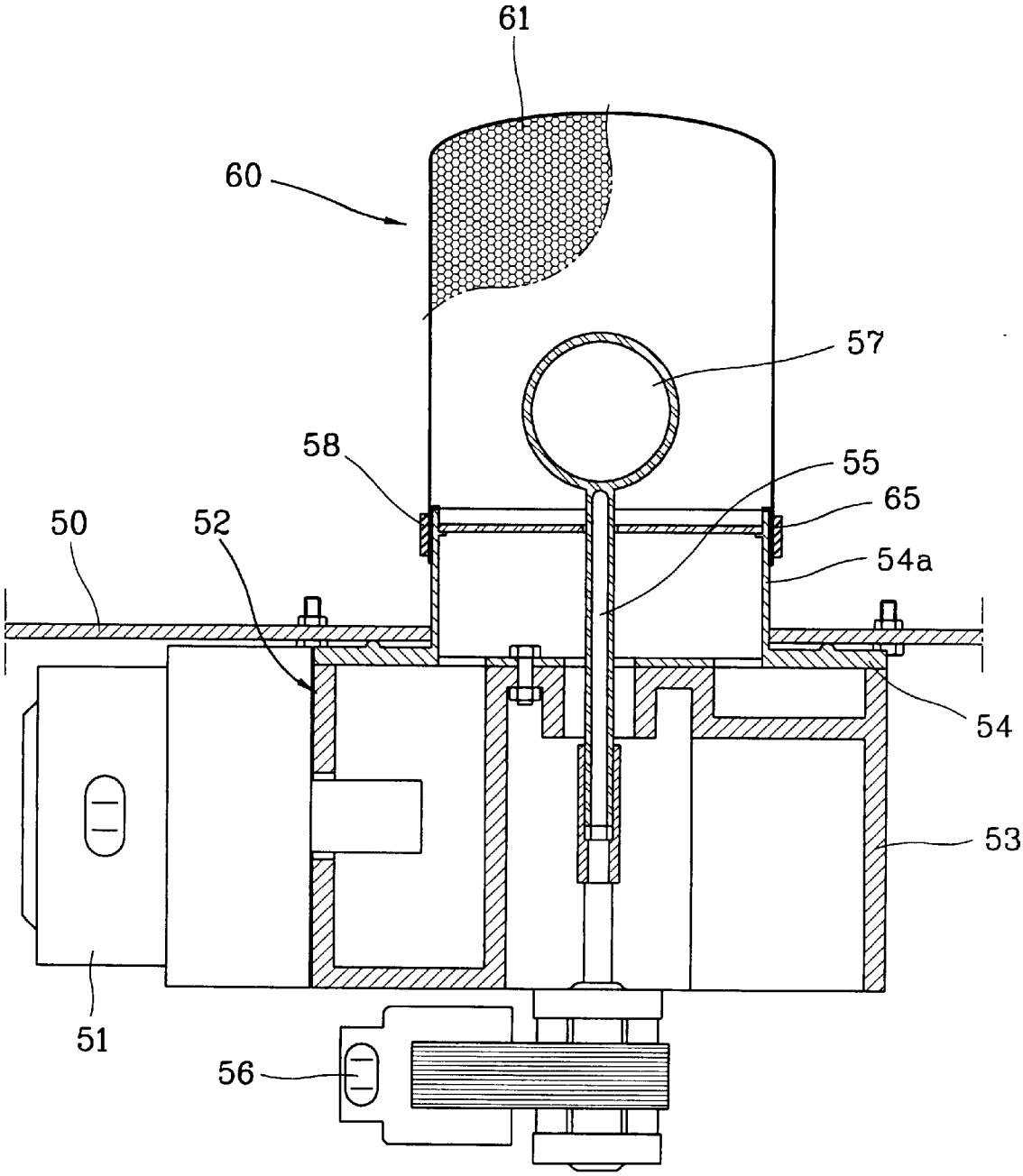
FIG. 6 is a sectional view of major parts of a microwave lighting apparatus having the resonator in accordance with the first embodiment of the present invention.

FIG. 5 is a perspective view of a resonator in accordance with a first embodiment of the present invention, and FIG. 6 is a sectional view of major parts of a microwave lighting apparatus having the resonator in accordance with the first embodiment of the present invention.

A resonator 60 in accordance with a first embodiment of the present invention is formed in a cylindrical form with one side opened and the other side clogged, in which a light bulb 57 is inserted to generate light as a substance encapsulated therein becomes plasma by a microwave energy transmitted through a waveguide 52.

The resonator 60 has a mesh structure so as to prevent microwave from leaking and transmit light radiated from the light bulb 57. The mesh structure is continuously formed by an electro-forming method without a joint.

In other words, as for the resonator 60, the mesh portion formed in a mesh structure is formed at the cylindrical portion 62 and the clogged front portion 63. In this case, especially, the cylindrical portion 62 and the front portion 63 are integrally formed continuously, rather than being mutually coupled by welding.

A plurality of holes 61*a* forming the mesh portion 61 of the resonator 60 are formed with the same sizes and same intervals over the entire part.

A fixing portion 65 is formed in a clogged shape without a mesh structure at the surrounding portion of the opened side, so as to be inserted to an outlet portion 54*a* of the waveguide 52 of the resonator 60.

A plurality of slit portions 65*a* are formed at the end portion of the fixing portion 65 in the cylindrical direction, so that it can be easily inserted by being extended in the circumferential direction when being assembled to the outlet portion 54*a* of the waveguide 52.

As the resonator 60 is integrally fabricated by the electro-forming method, the inner diameter, that is, the sectional area, becomes the same or smaller as it goes to the opened portion, that is, as it goes from the fixing portion 65 to the clogged front portion 63, to facilitate separation of the master, the model.

An assembly process of the resonator constructed as described above will now be explained with reference to FIG. 5.

A magnetron 51 for generating microwave is assembled at one side of a main body 53 of the waveguide 52, and a waveguide cover 54 with an outlet portion 54*a* formed to output microwave is coupled at the opened front side of the waveguide main body 53.

The outlet portion 54*a* of the waveiguide cover 54 is formed cylindrical and protruded forwardly of the case 50 as long as a predetermined length.

A motor shaft 55 for rotating the light bulb 57 is penetratingly installed at the center of the waveguide main body 53 and waveguide cover 54, and a light bulb motor 56 for rotating the motor shaft 55 is fixed at the rear side of the waveguide main body 53. The light bulb 57 rotated by being connected to the motor shaft 55 is positioned at the front side of the waveguide cover 54.

A resonator 60 is installed at the outlet portion 54*a* of the waveguide cover 54 to impound the microwave transmitted through the waveguide 53 and transmits light radiated from the light bulb 57.

That is, the fixing portion 65, the opened portion of the resonator 60, is inserted to be assembled to the outer side of the outlet portion 54*a* of the waveguide cover 54. At this time, the plurality of the slit portions 65*a* are formed at the fixing portion 65 and easily inserted to the outer side of the outlet portion 54*a*.

Thereafter, when the fixing portion 65 of the resonator 60 is inserted into the outlet portion 54*a* of the waveguide cover 54, a fixing band 58 and the like is wound around the fixing portion 65 to prevent the resonator 60 from separating from the waveguide, thereby completing assembling of the resonator.

As for the resonator 60 in accordance with the present invention assembled at the outlet portion 54*a* of the waveguide 52, rather than fabricating each portion through the etching method and combining them by welding likewise in the conventional art as described above, the whole part of the resonator 60 is integrally formed by the electro-forming method. By doing that, there is no possibility that the welded portion is detached and the plurality of holes 61*a* forming the mesh portion 61 are continuously formed without a clogged portion. Then, the aperture efficiency can be heightened as much and the light radiated from the light bulb 57 can be transmitted outwardly.

Figure 7:
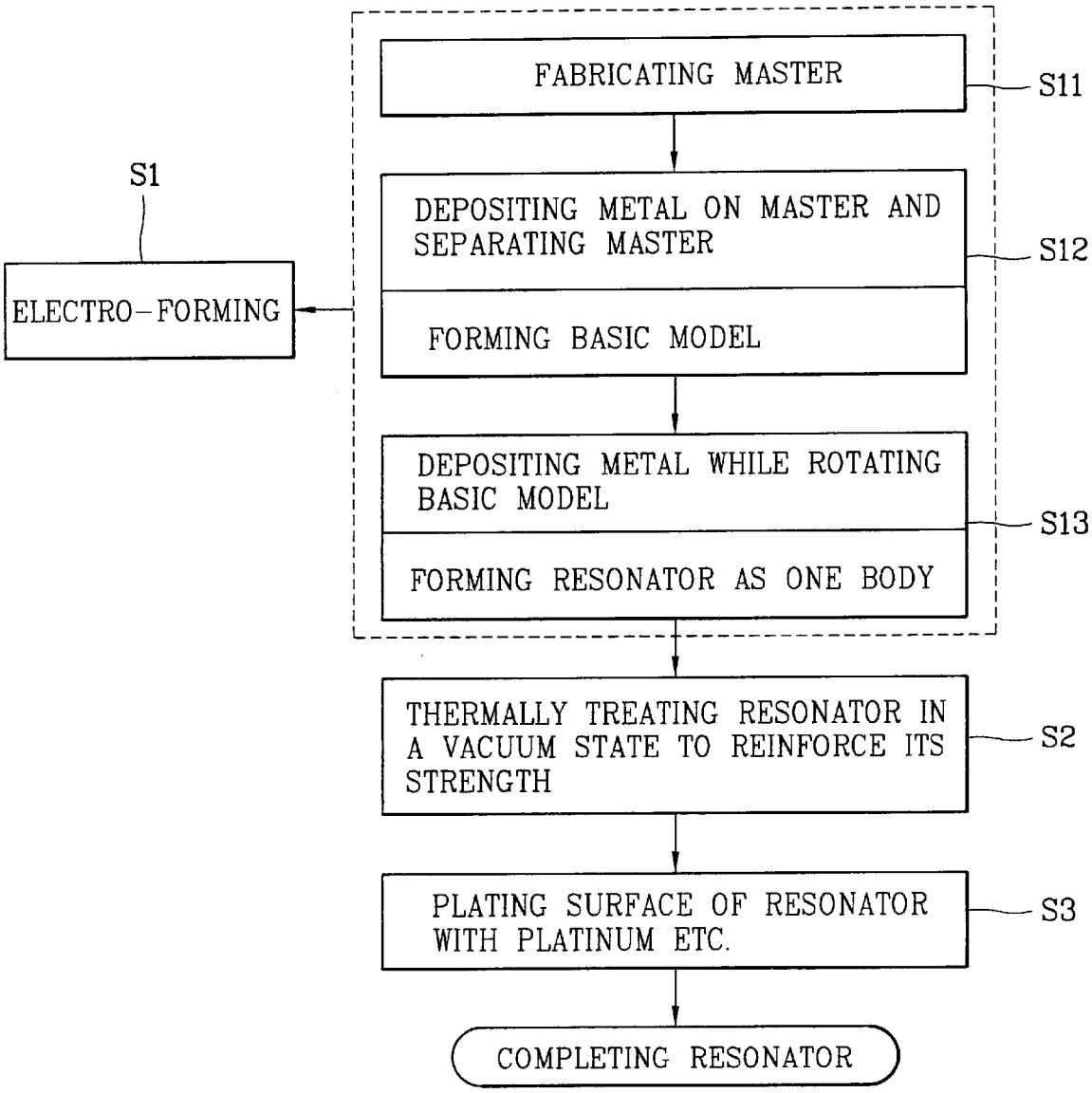
FIG. 7 is a flow chart of a method for manufacturing a resonator in accordance with a preferred embodiment of the present invention.

A method for manufacturing the resonator in accordance with a first embodiment of the present invention will now be described with reference to FIG. 7.

First, a cylindrical resonator having a continuous method structure without a joint with one side opened and the other side clogged by using the electro-forming method is fabricated as one body (step S1).

The electro-forming method is mostly used for fabricating a fine design and a cubic metal molded product. The electro-forming method is to form a master of the same shape as that of a molded product and deposit an electrolysis precipitation on the master by using a principle of an electro-plating to thereby fabricate a metal molded product.

As described above, the process (step S10) for forming the resonator by using the electro-forming method includes the steps of fabricating the master (step S11), molding the basic model by using the master (step S12), and depositing a metal on the basis model with the electro-plating principle and molding the resonator.

In the process (step S11) for fabricating the master, the final master can be fabricated by using the initial master, so that the initial master is washed to be released and put in a metal solution tank to form a master by electro-plating. And then, the master is charged with a silicon sealant, abraded and washed, thereby completing the final master.

In the process (step S12) for molding the basic model of the resonator with the final master, for an easy separation of the basic model, the master is coated with a basic release agent and washed. And then, the master is put in a tank, on which a metal is deposited to a predetermined thickness to mold the basic model, and then the basic model is separated from the master.

At this time, at least two of nickel, a nickel cobalt alloy, stainless steel, copper, a copper alloy are mixed in the tank, and as the metal is deposited on the master to form the basic model. The master is formed to have the same sectional area or to become gradually small as it goes from the opened portion to inner side so that the basic model can be easily separated.

In the process (step S13) for molding the resonator by using the basic model, the basic model is put in the metal solution tank and the metal is deposited on the basis model by electro-plating until it gets a desired thickness and a desired form, and then washed. Then, the cylindrical resonator is fabricated.

At this time, thanks to the metal deposited at the basic model, the resonator is molded more firmly and thicker, the whole part of the resonator is integrally formed in the cylindrical form, and the holes forming the mesh structure are formed evenly at constant intervals without a clogged portion.

Next, after the resonator is molded through the electro-forming, during the electro-forming process, there may exist a dissolved gas in the metal plated at the basic model, the resonator is heat-treated at a temperature of 400~700° C. in a vacuum space to remove the dissolved gas and reinforce its strength (step S2).

And then, one of silver, platinum, a platinum family is plated on the surface of the heat-treated resonator, to thereby complete the final resonator (S3).

As so far described, in case that the resonator is fabricated by electro-forming, as shown in FIG. 5, the resonator 60 can be fabricated as one body without any coupled portion, and various forms of resonators can be easily fabricated according to the shape of the master and the basic model.

Figure 8:
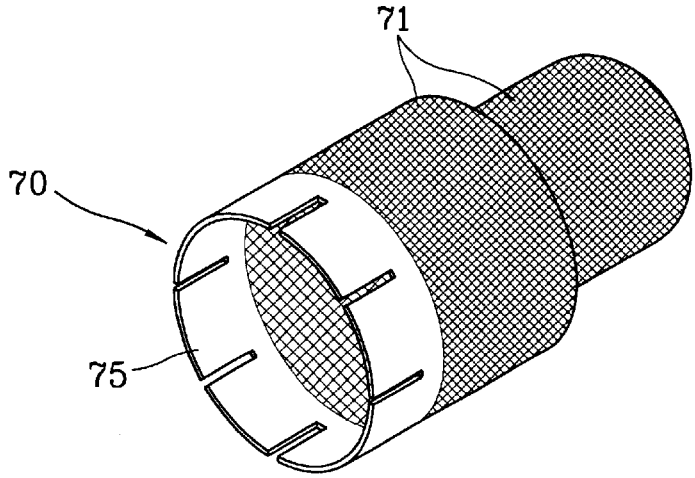
FIG. 8 is a perspective view of a resonator in accordance with a second embodiment of the present invention.

FIG. 8 is a perspective view of a resonator in accordance with a second embodiment of the present invention.

The resonator in accordance with the second embodiment of the present invention is manufactured by adopting the above described resonator manufacturing method. In this respect, various shapes of resonators can be manufactured according to a design condition and necessity of a lighting apparatus.

The resonator 70 of the second embodiment of the present invention can be fabricated by the electro-forming method, having a multi-step cylindrical structure that a cylinder is continuously formed to have a diameter which is gradually smaller as it goes from the opened portion to the inner side.

The resonator 70 includes a mesh portion 71 which is continuously formed without a joint except for a fixing portion 75, the opened side. A plurality of holes forming the mesh portion 71 are formed to have the same sizes and the same is intervals.

Figure 9:
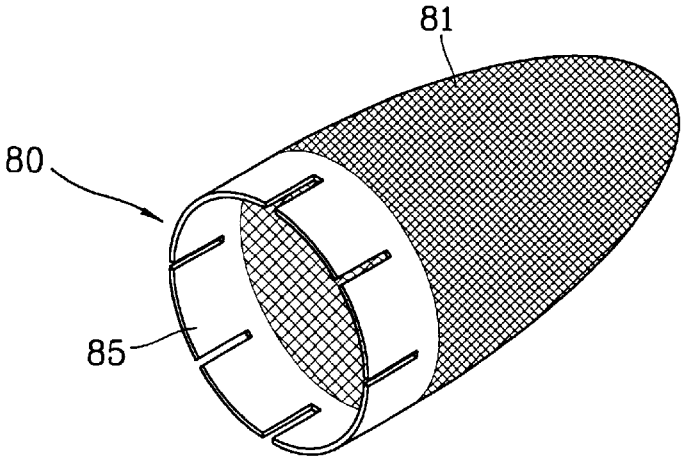
FIG. 9 is a perspective view of a resonator in accordance with a third embodiment of the present invention.

FIG. 9 is a perspective view of a resonator in accordance with a third embodiment of the present invention.

Likewise in the second embodiment of the present invention, the resonator in accordance with the third embodiment of the present invention is molded by using the resonator manufacturing method in accordance with the first embodiment.

A resonator 80 of the third embodiment of the present invention is formed with one side opened and the other side clogged and its section may have various forms such as a conic shape, that is, a hemispheric form or a parabolic form, or an oval form.

The resonator 80 also includes a mesh portion 81 which is continuously formed without a joint except a fixing portion 8, and a plurality of holes forming the mesh portion 81 are formed to have the same sizes and same intervals, thereby heightening the transmissivity of the light radiated from the light bulb.

Figure 10:
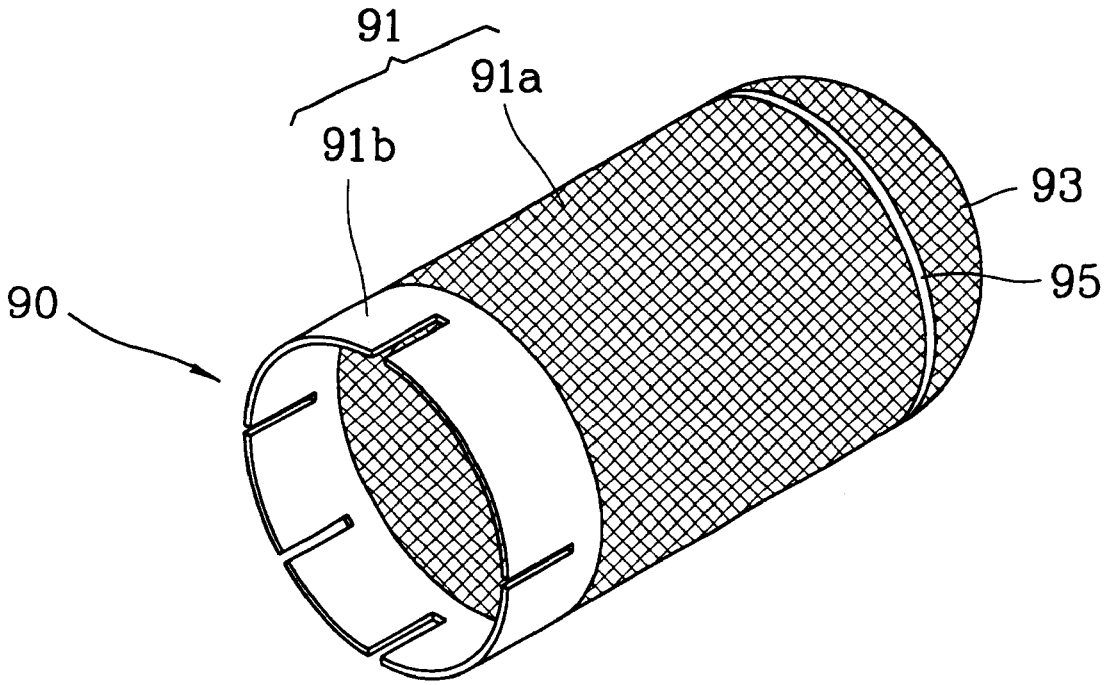
FIG. 10 is a perspective view of a resonator in accordance with a fourth embodiment of the present invention.

FIG. 10 is a perspective view of a resonator in accordance with a fourth embodiment of the present invention.

Unlike the process in which the cylindrical portion 62 and the clogged front portion 63 of the resonator 60 are integrally formed without a joint in accordance with the first embodiment of the present invention, a resonator 90 of the fourth embodiment of the present invention is formed in such a manner that a cylindrical portion 91 and a front portion 93 are separately fabricated and welded to be fixed.

In detail, the cylindrical portion 91 is formed with both sides opened by using the electro-forming method. The cylindrical portion 91 includes a mesh portion 91*a* having a mesh structure integrally formed without a joint and a fixing portion 91*b* without a mesh structure.

Meanwhile, a hemispheric front portion 93 in a mesh structure is separately formed by using the electro-forming method.

The cylindrical portion 91 and the front portion 93 are attached each other to be fixed, thereby fabricating a resonator.

At this time, it is preferred that the cylindrical portion 91 and the front portion 93 are attached in such a manner that they are put into contact with each other without being overlapped and welded by applying a reinforcing member 95 thereon.

After the cylindrical portion 91 and the front portion 93 are molded by the electro-forming method and welded to mold the resonator 90, the resonator 90 is reinforced by being heat-treated likewise in the first embodiment. And then, the surface of the resonator 90 is plated to have a high light reflectivity, thereby completing the resonator of the fourth embodiment of the present invention.

As so far described, the resonator for a microwave lighting apparatus of the present invention has many advantages.

For example, first, since the portion of the mesh structure is integrally formed as one body without a joint rather than being welded to be coupled, the microwave is prevented from leaking.

Secondly, since the holes of the mesh portion are uniformly formed without any clogged portion, the light transmittance area is enlarged, improving the light efficiency of the lighting apparatus.

In addition, in case of the method for manufacturing a resonator for a microwave lighting apparatus of the present invention has advantages that, since the resonator is integrally fabricated without a joint by using the electro-forming method, the resonator can be easily fabricated and can be fabricated in various forms according to a design condition of a lighting apparatus and as necessary.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A resonator for use in microwave lighting apparatus having a cavity with one side opened, and a mesh portion formed at one portion of wall of the cavity, so as to prevent microwave being transmitted through a waveguide from leaking and transmit outwardly light radiated from a light bulb, wherein the mesh portion is formed integral without a joint therein.

2. The resonator of claim 1, wherein the mesh portion is continuously formed at a circumferential portion of a body and at a front portion, the opposite portion of the opened portion.

3. The resonator of claim 2, wherein a fixing portion is formed in a clogged structure rather than in a mesh structure at the opened portion, so as to be installed at an outlet portion of the waveguide.

4. The resonator of claim 3, wherein the fixing portion includes a plurality of slit portions, so as to be easily inserted into the waveguide.

5. The resonator of claim 1 is formed in a cylinder shape.

6. The resonator of claim 1 is formed in a multi-step cylindrical form that a cylinder is formed with different inner diameters successively.

7. The resonator of claim 6 is formed in such a manner that the inner sectional area becomes gradually smaller as it goes from the opened portion to the inner side.

8. The resonator of claim 1 is formed in a conic shape that the inner sectional area becomes gradually smaller as it goes from the opened portion to the inner side.

9. A resonator of a microwave lighting apparatus includes an opening portion formed connected to a waveguide at one side of a cylindrical portion and a clogged front portion at the opposite side of the opening portion, a mesh portion is formed at the cylindrical portion and the front portion and connected through a fixing member, the mesh portion is integrally formed without a joint.

10. A method for manufacturing a resonator of a microwave lighting apparatus comprises the steps of:

forming a cylindrical resonator with one side opened and the other side clogged by using an electro-forming method to have a mesh structure without a joint; and heat-treating the resonator to reinforce its strength.

11. The method of claim 10, wherein, in the step of forming the resonator, the resonator is manufactured by one of metals including nickel, stainless steel and copper alloy.

12. The method of claim 10, wherein, in the reinforcing step, the resonator is heat-treated at a temperature of 400~700° C. in a vacuum state so as to remove a dissolved gas remaining in the metal during the electro-forming process.

13. The method of claim 10, further comprises a step of plating the surface of the resonator with a metal so as to have a high light reflectivity after the reinforcing step.

14. The method of claim 13, wherein, in the surface-plating step, the surface of the resonator is plated with one of silver, platinum and a platinum family.

15. A method for manufacturing a resonator of a microwave lighting apparatus comprising the steps of:

forming a cylindrical body with both sides opened by using an electro-forming method to have a mesh structure without a joint, separately fabricating a front portion in a mesh structure, attaching it to one side of the cylindrical body to form a resonator; and heat-treating the resonator to reinforce its strength.

16. The method of claim 15, wherein, in the reinforcing step, the resonator is heat-treated at a temperature of 400~700° C. in a vacuum state so as to remove a dissolved gas remaining in metal during the electro-forming process.

17. The method of claim 15, further comprises a step of plating the surface of the resonator with a metal so as to have a high light reflectivity after the reinforcing step.

* * * * *